United States Patent [19]

Conrad

[11] Patent Number: 5,038,700

[45] Date of Patent: Aug. 13, 1991

[54] NOVEL SAIL CONSTRUCTION AND SAILS MADE ACCORDINGLY

[75] Inventor: Peter G. Conrad, Old Lyme, Conn.

[73] Assignee: Genesis Composites, Inc., Greensboro, Ga.

[21] Appl. No.: 359,406

[22] Filed: May 31, 1989

[51] Int. Cl.[5] ..... B63H 9/04

[52] U.S. Cl. ..... 114/103; 114/39.1

[58] Field of Search ..... 114/39.1, 102, 103, 114/109, 113, 114, 115, 111; 428/293, 294, 253, 114, 247, 910, 246, 110, 104, 105

[56] References Cited

U.S. PATENT DOCUMENTS

| | | | |
|---|---|---|---|
| 3,903,826 | 9/1975 | Anderson | 114/103 |
| 3,954,076 | 5/1976 | Fracker | 114/103 |
| 4,679,519 | 7/1987 | Linville | 114/103 |
| 4,708,080 | 11/1987 | Conrad | 114/113 X |
| 4,945,848 | 8/1990 | Linville | 114/103 |

*Primary Examiner*—Ed Swinehart

[57] ABSTRACT

An improved sail of thread and polymer film construction including for panels and at corners of sail foam layers; novel batten pocket construction includes foam-film combinations.

19 Claims, 5 Drawing Sheets

NOVEL SAIL CONSTRUCTION AND SAILS MADE ACCORDINGLY

This invention relates to a novel method of sail construction. More particularly, this invention relates to a said construction having a number of advantages in the manufacture of sail or in the use of a sail; still further, this invention relates to advantages in the sail when the same is used for its intended purpose, such as providing a sail of lighter weight for equal load carrying capacity or greater load carrying capacity for the same weight when compared to the best prior art sails constructed in accordance with prior art woven cloth construction techniques. Accordingly, the novel sails as constructed in accordance with the novel methods are within the contemplation of this invention.

BRIEF BACKGROUND FOR THE INVENTION

In the prior art, typically sails have been constructed by sewing a woven material. Woven material is based on the weft and warp technology with the yarns running over and under, thus introducing inherent weakness in the sail when it is loaded on the bias or when the sail is subjected to a load such that the load line does not follow the threads, e.g., the warp threads, or expressing it otherwise, when the warp threads do not follow the load lines in a sail and "run off" the cloth.

In accordance with a number of techniques, panels in the sail are rotated so that appropriate panels can be cut and made to follow the line representing the force being exerted on the sail. Typically the current sails are made in panels that form catenaries connecting a clew and a head, a head and a tack, and a tack and a clew. In order to reduce the cost as well as the weight of the sail, the best prior art warp and weft based sails describing this problem of orientation of catenaries is found in my U.S. Pat. No. 4,593,639, which is incorporated by reference herein Further, and as a sizable improvement thereover, my U.S. Pat. No. 4,708,080 has advanced the art by a great step, eliminating altogether the warp, weft and cloth-panel orientation technology. The sails made in accordance with my U.S. Pat. No. 4,708,080 represent and entirely rely on the proper shaping of the sail by the use of threads in a properly tailored manner for each panel using a simple panel layout of a reduced number of panels. Thus, proper orientation of each of the threads in a panel is achieved. Proper thread size and thread count density in a particular location in a particular panel is now possible. Each panel bears the stress on it in a manner causing substantially reduced distortion of the sail when the sail is subjected to use for its intended purpose. Accordingly, the predeterminately disposed threads in a sail panel now form the proper catenary in a sail in an improved manner, further reducing the weight of the sail and improving its performance and durability. U.S. Pat. No. 4,708,080 is also incorporated by reference herein.

In these two patents, as well as in related U.S. Pat. Nos. 4,624,205, 4,702,190, 4,815,409 and 4,831,953 are included a number of references. These references illustrate the prior art and the background for the inventions. These references mentioned in the above patents are considered as part of the background summed up herein.

A special mention, however, should be made to U.S. Pat. No. 3,954,076 to Fracker, mentioned in U.S. Pat. No. 4,593,639, which discloses the reinforcement in the tack, clew and head of a said by having fanned rectangles of the sail material sewn onto the sail, thus distributing the load from the clew, tack or head.

Subsequent developments made after the filing of U.S. Pat. No. 4,593,639 have shown that the structural members have far better reinforcement capabilities, especially when used in the manner such as disclosed in U.S. Pat. No. 4,593,639, thus representing the technology of joining, e.g., the tack and the clew of a sail in a structure. By such structure incorporation in sails, superior sails have been achieved.

Although the improvements shown in U.S. Pat. No. 4,593,639 have greatly benefited the sailmaking art and a number of sails have been made by this technology, further improvements shown by U.S. Pat. No. 4,708,080 and the associated cost savings have provided a greater incentive to develop further improvements.

Thus, the present invention relates to further improvements associated with the technology represented by U.S. Pat. No. 4,708,080.

BRIEF DESCRIPTION OF THE INVENTION

In accordance with the present invention, further savings and advantages have been realized by abandoning still more of the prior art technology associated with woven cloth material. Accordingly, the present invention relates to further advances in the construction of the sails and sails illustrated in U.S. Pat. No. 4,708,080, and especially in the construction of lightweight sails, such as spinnakers, the corners for these sails, such as head, tack and clew, reef points for mainsails and other incorporated components in the sail, such as batten pockets, spreader patches and the like.

Still further, in the improvement of the sail construction according to the technique in U.S. Pat. No. 4,708,080, other advantages have unexpectedly resulted therefrom, such as the use of film material of heretofore unrecognized properties when used in combination with the construction techniques and construction of sails. Thus, composite jib or mainsails, where there have a panel or all panels made of a film with threads, foam, and film with or without threads, are now disclosed. For example, tabling material such as luff tape and leech tape can now be employed in the combination by relying on film technology without employing woven materials.

Still further, sail construction has thus been improved to such a degree that sails, such as spinnaker sails, jib sails and mainsails, can now be produced with improved overall performance for the intended purpose with considerable economic savings in material and labor and, more importantly, at no sacrifice in usefulness and durability.

DETAILED DESCRIPTION OF THE INVENTION AND EMBODIMENTS THEREOF

With reference to the drawings herein,

FIG. 1 illustrates in a side view a folded-in-half spinnaker sail;

FIGS. 2 and 2*a* and 2*d* illustrate in plan view edge component parts of the spinnaker placed around the periphery thereof and the composite head patch;

Figure 3:
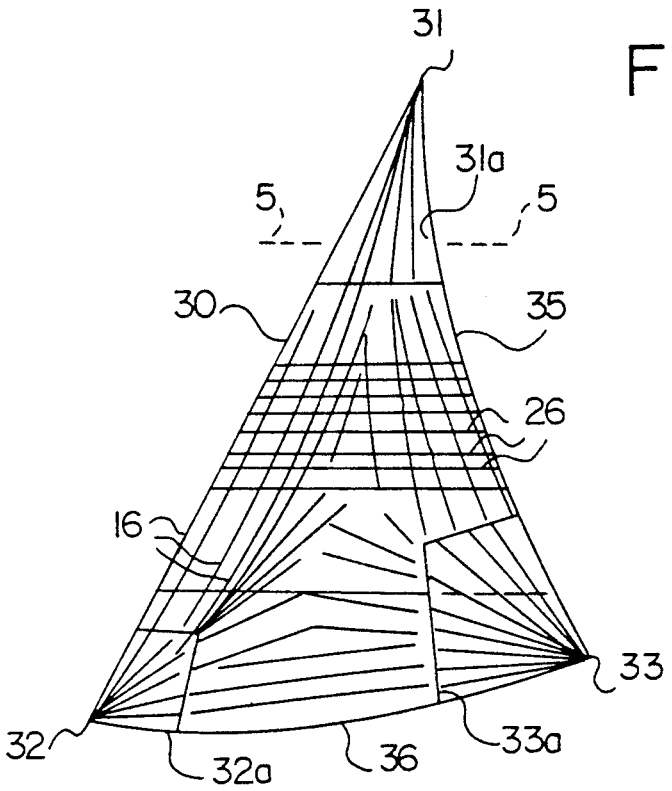
FIG. 3 illustrates in plan view a typical jib sail.
Figure 5:
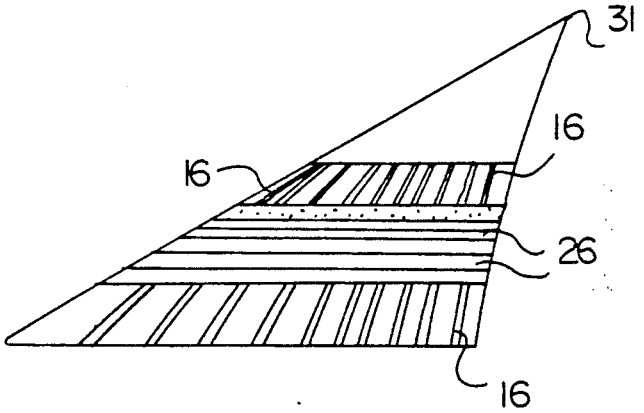
Figure 4:
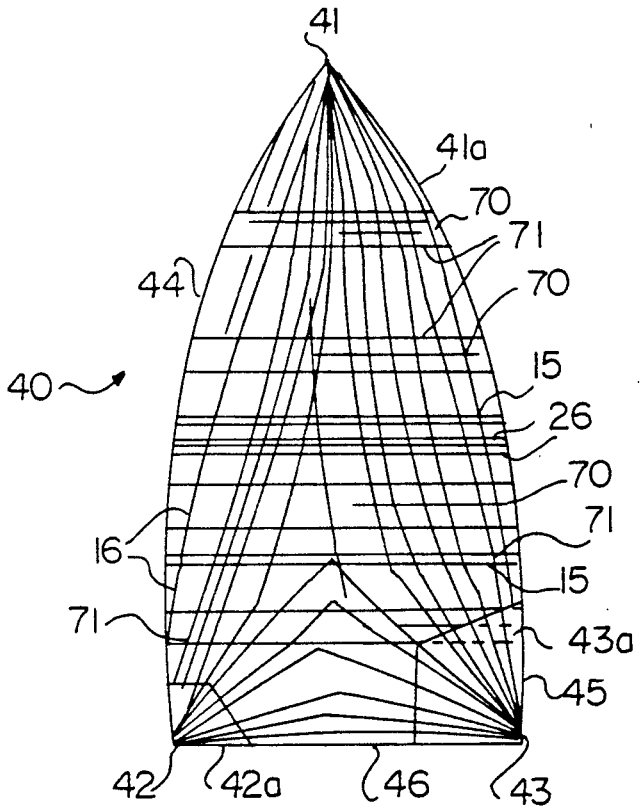
FIG. 4 illustrates in plan view a typical mainsail for a sloop or split rigged; boat, such as a ketch or a yawl.
Figure 4B:
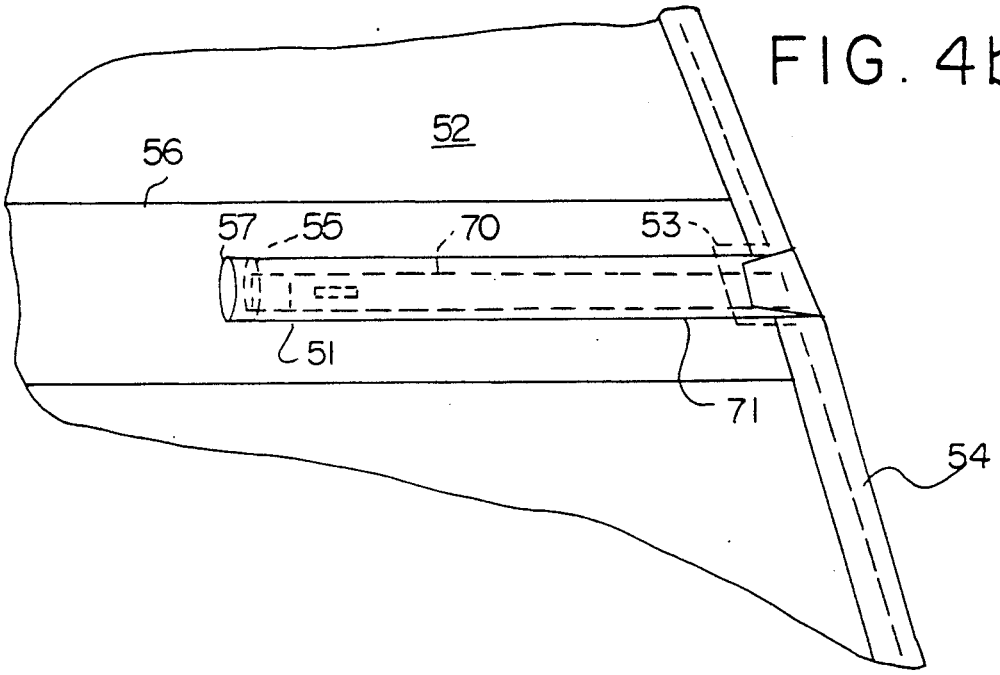
Figure 4A:
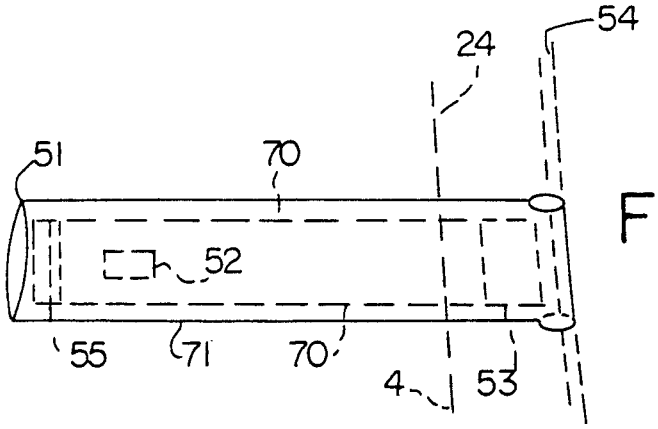

FIGS. 4*a* and 4*b* illustrate in a plan view a component part for the mainsail of FIG. 4 used in connection with a sail, i.e., batten pockets;

FIG. 5 illustrates a head patch along line 5—5 of FIG. 3 in partial cross sections for the various layers in said patch and in a perspective view as well as shows an assembly of the various layers in a patch with each successive layer being exposed to aid in the presentation of the sail constructed according to the invention.

Figure 1:
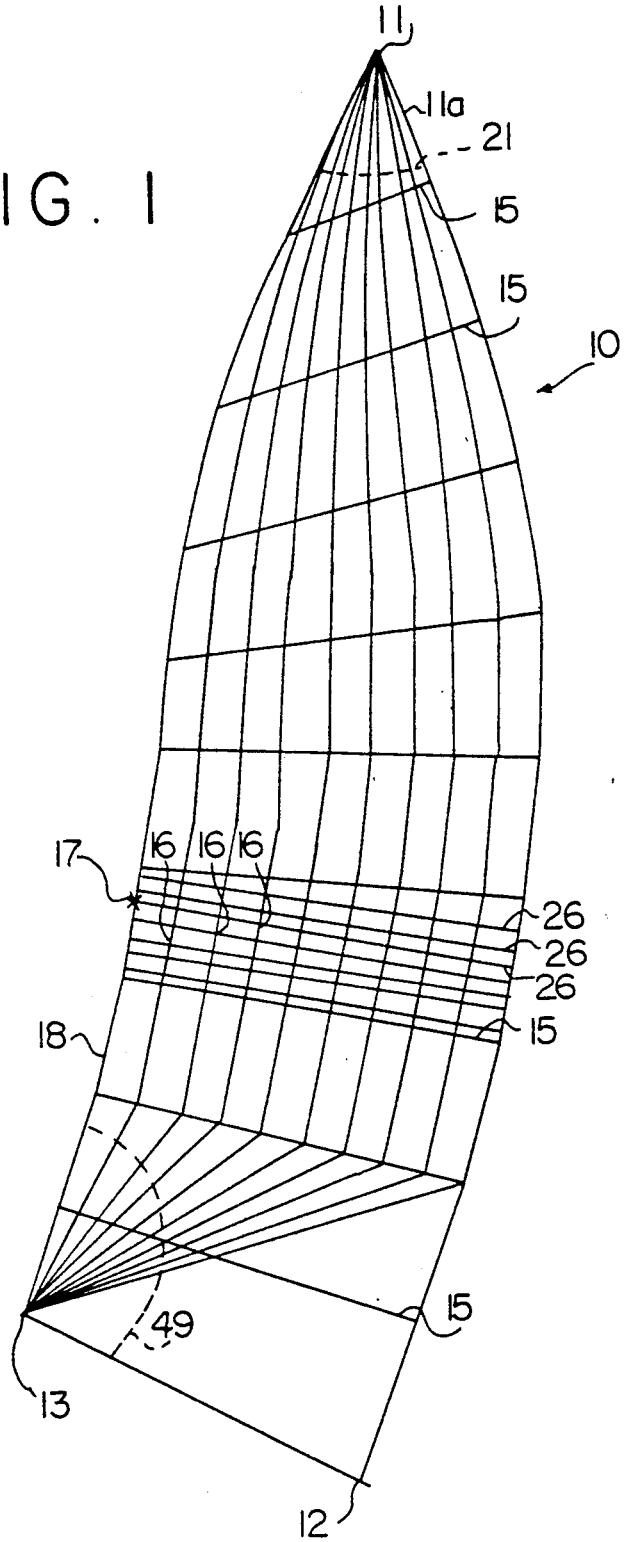

Turning now specifically to the drawings, in FIG. 1 the spinnaker sail 10 has a head 11, clew 13 and tack 14. The bottom corner representing tack 14 is not shown, as the spinnaker is folded in half and is symmetrical about the centerline. However, the other side of the sail is a mirror image of the side shown, and thus can best be represented for its accurate shape by being folded about midline 12. In FIG. 1, the midline is the rightmost line on the spinnaker sail.

The sail consists of ten panels, not specifically identified except for the head panel 11*a*. Each of the panels is joined to the next panel by a seam 15. It is to be noted that seam orientation in the sail is independent of the fiber orientation and vice-versa. That is not possible using cloth technology.

Although not all of the threads connecting the head 11 to the clew 13 have been shown, these are evident from the catenary location of these threads on the spinnaker. These threads are shown figuratively as 16 and follow the precepts as shown in U.S. Pat. No. 4,708,080 for each of the panels, as well as the density thereof. Crossover point 17 has been shown on the leech 18 of the spinnaker 10. Crossover point 17 is defined as the point when a straight edge is placed on the drawing on points 13 and 11, and the location where the line intersects the leech 18 at point 17. This point is defined as "cross-over point".

Inasmuch as in a side view the catenaries change the direction at that point, namely—the "S" curve defined by leech 18 changes from a concave to a convex shape, the catenaries below crossover point 17 are concave and above crossover point 17 are convex in side view. In front view of the spinnaker shown by phantom lines in FIG. 2 as 16, the catenaries follow a catenary line from head 11 to clew 18 or tack 14.

It is known that spinnakers typically fail at the crossover point 17 on the luff or at the head panel 11*a* when the sail has been overstressed. Other failures are less predominant from the failures initiated at crossover point 17 on the luff. These other locations are the clew 13 and/or tack 14. Most of the stress on the spinnaker is in the luff 23 or leech 18 location near the crossover point 17. However, the point load locations, such as head 11, clew 13 and tack 14, also concentrate the load in the sail.

Because of the freedom in the construction provided by U.S. Pat. No. 4,708,080, the improved spinnaker at the crossover point 17 and one of the panels above and below thereof may carry extra threads in such panels in the luff 23 area and leech 18 are, i.e., about 1/5 to ¼ width of the panel from each edge of the sail. Thus, the failure mode is not dependent on the woven cloth technology and the bias problems presently inherent in all spinnaker construction and may be circumvented by the added capability of transmitting the load and the stress in the sail without failure thereof.

The reason for the failure at crossover point 17 is based on the experience that the free edge of the sail, whether concave or convex, does not carry the load, i.e., the load is inside the sail and the load is carried in a straight line from the head to the tack. Because the load must, however, be confined in the sail, it must follow its contour by the catenaries, and the only place where it crosses over, e.g., at crossover point 17 on the luff 23, is the weakest part of the sail.

Prior art attempts to make sails out of laminates made of scrim material or like material have failed because it was not known how to address the problems inherent in supporting, strengthening and distributing a load in such sails, except to substitute a heavier material and base it on cloth technology. Nevertheless, the fact that the sail was so heavily stressed at certain points, such as crossover point 17, as well as the head and the tack, generally was addressed improperly, such as by rotation of the panels and rotation of the cloth or simply adding patches.

For example, the cutting of the spinnaker and the shaping of the panels has proceeded from "cross-cut" to "radial head" to "tri-radial" to "offset tri-radial" spinnakers, all requiring a great number of cutting and sewing steps. These developments are well known in the art and need not be described herein, but needless to say, the use of the material in such spinnaker is fairly enormous. The steps used for making these spinnakers have added complexity to the point where cutting and sewing of the material is extremely labor and material intensive. FIG. 1, however, represents a spinnaker that has returned to the original panel shape of the spinnakers without any of the disadvantages of the spinnaker cloth waste dictated by the shaping of panels, such as illustrated by subsequent developments identified as cross-cut, radial head, tri-radial and "offset" tri-radial spinnakers. This advantage has been realized because of the seam-fiber orientation independence previously mentioned.

For a maxiboat spinnaker, that is, a boat of about 80 feet long, the useful sail area for a spinnaker is about 650 square yards, whereas the material that is needed to cut and shape the panels is about 850 square yards. Hence, the savings for each of the panels made in accordance with the present invention are sizable, without the disadvantages of the use of an enormous number of material gores and seams to achieve the proper shaping of the sails. Moreover, polymer films, as further disclosed herein, may be used for the sail film membrane and the threads 16 and 26 being confined therebetween; the threads act as proper structure for the sail.

Accordingly, in each panel, as shown by the representative thread line 16, the proper orientation of the catenary can now be achieved by employing a sufficient number and density of appropriate threads of the type most suitable for the purpose. For example, for running spinnakers, these threads may be nylon threads, and for reaching spinnakers, these may be appropriately Dacron or even Kevlar in appropriate locations.

The advantage, however, over the prior art resides in the ability to properly construct the highly stressed areas of the spinnaker, namely--the crossover point 17 and the head, the clew, and the tack 11, 13 and 14, respectively, the leech 18 and luff 23 area (i.e., about 1/5 to ⅓ of panel length) in combination with a proper polymer film.

Further, in accordance with the present invention each of the corners of the sail has an additional patch 19 for clew 13, a tack patch 20 (not shown in FIG. 1, but shown in FIG. 2) and head patch 21. The head patch 21 has been shown in FIG. 2*a*. The clew patch 19 has also been shown in FIG. 2, and the tack patch 20 has likewise been shown in FIG. 2. These patches, as shown in there Figures, are made in the following manner.

Head patch 21 has a layer of foam 21*c* of a thickness from about 1/32 to ⅛ in thickness. Thicker sheets of foam, e.g., up to 3/16, may also be used, but the inherent flexibility of foam must be maintained. Typically, the foam is made from polyethylene, polypropylene, or polyurethane, preferably aliphatic polyester polyurethane, and is preferably a closed cell foam. Other foams that may be used are ionomer foams, isocyanurate foams, modified phenylene ether foams, sulfone foams, polycarbonate foams, such as Lexan foams, epoxy foams, polyetherimide foams, crosslinked polyethylene foams, polyimide foams, crosslinked polypropylene foams, thermoplastic polyester foams, polyetherblock amide foams, polyvinylidene fluoride foams, polychlorotrifluoro ethylene foams, and the like. Foams of acceptable flexibility and fold resistance (flex life) are now available. These foams may be available from sources listed in *Modern Plastics Encyclopedia,* e.g., for 1989.

Figure 2:
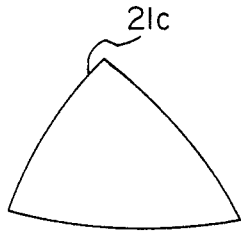
Figure 2B:
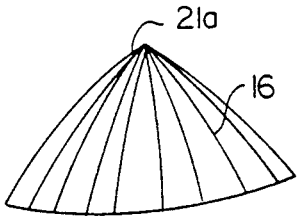

A thin sheet of this foam is available with an adhesive coating on one or both sides. A release sheet on one side of the foam is sufficient if the foam is rolled up on itself. A source of such foam is Duraco, 1025 West North Avenue, Chicago, Ill. 60622. The foam may be attached to the spinnaker 10 in the location shown in the drawing in FIG. 1 as 21, and another layer of plastic film 21*a* with the threads 16 attached thereto as shown in FIG. 2. The threads 16 are disposed along the principal force lines for patch 21 to film 21*a* in appropriately varied density and/or size. After the foam 21*c* material in patch 21 has been attached to the sail panel 11*a*, the foam 21*c* forming patch 21 is uncovered by removing the release layer from such a foam material and placing the plastic film 21*a* with threads 16 thereon on the foam material. The adhesion between the threads and the foam 21*c* in patch 21 is so great that the threads in the head patch 21, for example, can carry an enormous load. The shear between the foam attached to the underlying panel 11*a* and the film layer 21*a* with the thread 16 thereon is so great that the failure mode will occur first someplace else in the spinnaker rather than in the patch 21 attached thereto. In the same manner, an entire sail panel and/or an entire sail may be made as described above, i.e., threads 16 and 26 and a film carrying the same may be glued onto the foam and the other side covered in the same manner or only with a film. This type of sail has outstanding flogging resistance.

Another method of construction is to unroll a foam with an adhesive on both sides and a release paper on one side, place a preassembled film and fiber patch or panel on the exposed adhesive side, cut the foam to size, remove the release paper and place this assembly on the sail.

Figure 2A:
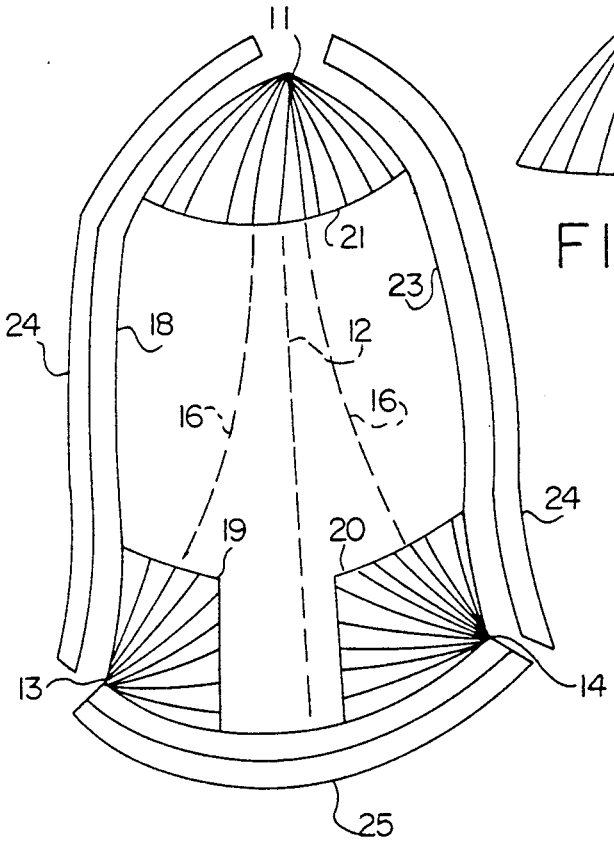

If necessary, another patch of the type as shown in FIG. 2*a* may be attached on the other side, that is, inside of head panel 11*a*, when such sail is employed for purposes such as a storm spinnaker and the like. However, so far it has been found that it is unnecessary to have more than one patch, although depending on the disposition of the threads, the thread count density, etc., in head panel 11*a* and on the additional plastic film layer 21*a*, it may be more advantageous to provide for two patches—one on the inside of the sail and another on the outside of the sail.

The same construction is also employed for the corner patches, such as shown for the clew 13 and tack 14, i.e., clew patch 19 and tack patch 20.

As film material for the patches and the sail membrane, one may use polyester film sold as Mylar by DuPont & Co.; polyvinylidene fluoride, e.g., TEDLAR ®, a DuPont & Co. trademarked product; fluoroplastics, such as ethylene chlorotrifluoro ethylene copolymer; ethylene tetrafluoro ethylene copolymer; fluorinated ethylene propylene copolymer; perfluoro alkoxy polymers; polychloro trifluoro ethylene copolymer; polyvinylidene fluoride; Nylon 11 and 12; other thermoplastic polyester polyalkyls; biaxially oriented polypropylene, etc.; an ideal yardstick for useful films and to determine the film properties most suitable for a said film is to use the TEDLAR ® film as a standard. If the properties of the film are equivalent to TEDLAR ® for equivalent thickness or if better, then the material is highly desirable. Typically the films on either side of the threads 16 and 26 may range from ½ mil (inches) up to 2 and 3 mil thickness depending on the location used. For light weather sails, lighter films are used, e.g., ¾ mil films.

Mylar, although used heretofore extensively in the sailcloth making art, is too brittle and not sufficiently puncture resistant or tear propagation resistant. TEDLAR ® has superior properties for each of the desirable criteria, e.g., flex life, tear propagation, puncture resistance, resistance to water absorption, tear strength, etc. These properties are determined in accordance with the test procedures identified in *Modern Plastics Encyclopedia,* McGraw-Hill, New York, N.Y., 1989.

Hence, for purposes of the present invention, a performance level is defined by a particular material, namely—TEDLAR ® for the film and the epoxy foam from Duraco for the foam material. Kevlar threads are the preferred material for loadbearing, Dacron for loadbearing and elasticity, and Nylon 6 for elasticity only.

Of course, laminated films for use on one side of the threads are also within the contemplation of the invention, e.g., TEDLAR ®-Mylar laminate; or laminates of one type of film on one side of threads 16 and another on the other side.

Returning to FIG. 2, proximate to the leech 18 a leech tape 24 has been shown. Inasmuch as the spinnaker shown is a symmetrical sail (unsymmetrical spinnakers are also known and are within this invention), the tape 24 for luff 23 is identified with the same number as the leech tape.

In addition, a foot is finished with foot tape 24 and is also used on the spinnaker to finish the edges thereof.

Typically a foot of a sail is finished with a foot tape e.g. 24 in FIG. 2 and that tape is sewn on the sail and is made of a heavier material such as a heavier gauge nylon or a woven nylon or Dacron material. However, in accordance with the novel construction, tape 24 and tape 25 for luff 23 and leech 48, respectively, are made of a polyurethane film preferably aliphatic polyester polyurethane such as of about up to 15 mil in thickness with an adhesive on one side. This tape also prevents tear initiation at the outer edge of the sail. This tape is folded and applied on both sides of a panel's edge, and it has been found to carry the force imposed on the luff and leech and resist tearing far better than a sewn tape which introduces at the periphery thereon stress concentration points, especially such as at cross over point 17. The stress concentration is introduced by the needle holes that are formed in a woven material upon sewing.

Returning now to FIG. 1, the panels shown at the crossover point 17 show perpendicular threads to the leech 18 and identified as 26. Perpendicular threads 26 may be laid across a film for a panel after the primary threads 16 have been placed on the same film for a panel. Threads 26 may be either parallel threads with a woven scrim with warp threads such as 2 picks per inch so as to facilitate the lamination when the material is placed on a film and laminated thereto. For a spinnaker, shown in FIG. 1, the following dimensions and materials are suggested: luff 47 ft.; foot 27 ft.; film 2 ply TEDLAR ® of about ½ mil; catenary fibers for head sections (first few panels) 3,000 denier polyester; same for foot and midpanels, i.e., 3,000 denier polyester; scrim, i.e., cross threads: 26 warp 4 per inch 220 denier, weft or fill threads 2 to 4 per inch 220 denier. All panels have the above described scrim.

Turning now to FIG. 3, it illustrates a typical jib sail (larger versions of which are sometimes called Genoa sails). The jib 30 has a head 31, a tack 32, and a clew 33. It has a luff 34 and a leech 35. Its foot has been identified as 36.

The sail consists of a number of panels. It has been constructed as previously described in my U.S. Pat. No. 4,708,080 with the threads 16 running as catenaries from the head 31 to clew 33 and from head 31 to tack 32. It may also be constructed, as explained herein, with an interlayer of foam with the threads next to the foam on one or both sides of the foam layer.

In addition, cross threads 26 have been shown for one of the panels, but are typically employed for all of the panels to give added strength, although structural members may also be employed for that purpose as described in my previously mentioned patent.

In FIG. 5 partial cross sections of the sail along line 5—5 of FIG. 3 have been shown in such manner as to allow easy visualization of the assembly of the sail in that particular location. Each of the successive layers has been presented in partial cross section with respect to the rest of the components. Each layer has been exposed so as to show the assembly construction for this sail including the threads therefor. Each material layer has been identified with legends for easy understanding of the presently claimed invention.

Each of the point load locations, that is, head 31, clew 33 and tack 32, are reinforced by one or more of the patches which were described in conjunction with the construction of the spinnaker sail.

These patches have been identified as 31*a*, 33*a* and 32*a* for the head, clew and tack patches, respectively.

Again, these patches may be of the size as necessary and typically carry the Kevlar threads on one surface thereof so as to give the added strength for the highly loaded (for this sail) point load locations.

These patches may be of one size on one side of the sail and another larger or smaller size on the other side of the sail. Thus the added strength at the head 31 and clew 33 would properly be imparted to the sail in use where the point loads are most concentrated for a jib sail.

Again, the luff 34 and the leech 35, as well as the foot 36, are finished in the same manner as described for the spinnaker sail with the appropriate luff, leech and foot tapes (not shown in FIG. 3). A sail in accordance with the invention was constructed of a luff dimension of 47 ft. and a foot dimension of 22.5 ft. of two layers of TEDLAR ® 0.001 inch thickness (one mil). Other sails have been constructed of a film being from 1.5 mil to 2 mil thick. Threads 16 are 3,000 denier Kevlar (adhesive is a urethane, single-part adhesive), and cross threads 26 forming the scrim are 4 warp threads per inch of 400 denier Kevlar and 2 fill or weft threads of 220 denier polyester. Tapes 24 and 25 are aliphatic polyester polyurethane from about 0.8 mils (0.008 inches) to about 12.5 mils (0.0125 inches).

Turning now to FIG. 4 which illustrates a mainsail 40, it has a head 41, a tack 42 and a clew 43. The mainsail as shown has five panels, but a greater number and lesser number of panels may be used as dictated by the size of the sail.

Typically the sail has four battens identified as 70 carried in batten pockets 71. The mainsail as shown has luff 44 which carries a luff rope (not shown) and leech 45. Leech 45 is finished again the same way as the finishing step shown for FIG. 2 for the spinnaker. Except heavier gauge materials may be used as necessary, i.e., from 5 mils to 15 mils, and the leech tape may carry also a leech line (not shown) in FIG. 4, shown in FIG. 4*a* as 54. For luff and foot appropriate bolt rope and; or grommets and slides may be provided, as it is well known in the art.

In a manner similar to that described for the finishing of the spinnaker in FIG. 2, a head patch 41*a*, a tack patch 42*a* and a clew patch 43*a* are likewise employed.

These patches again are made in the same manner as the patches described for the sail shown in FIGS. 1 and 3, and again may be on one side or on both sides of the sail.

Appropriate reef line patches are made in a similar manner as, e.g., patches 42*a* and 43*a*. For the sake of clarity these have not been shown in FIG. 4, but are amply described in the above patents incorporated by reference herein.

FIGS. 4*a* and 4*b* illustrate a batten pocket 71 and its construction in an assembly view and illustrate the further advantages accruing in the construction of the sails. In FIG. 4*a*, a tube 51 made of aromatic polyester polyurethane film of a thickness of about 8 to 15 mils is formed by gluing longitudinally a film sheet of appropriate dimension. A VELCRO ® i.e. a fiber loop-and-hook fastener; patch 52 is glued on each batten and also on the tube 51 (on inside before assembly). A woven inner cloth layer of Kevlar 53 is placed over the end of the precisely lengthwise cut tube 47 and glued to the tube 51. Thereafter the tube is glued on the sail at one of the locations for the battens. A leech cord 54 is confined within the previously described leech tape. An outer Kevlar material (woven material) is placed over the leech tape cord 54. A VELCRO ® piece 55 may be placed on the inside of tube 51 to close the tube after the batten has been inserted.

Turning now to FIG. 4*b*, after tube 51 has been glued on the mainsail 40, a foam layer 56 is placed thereover. The foam is of the same type as for the corner patches. A slit 57 is cut in the foam at the inner end of the batten 70 (the leech cord 54 is at the outer end of the batten 70). Through this slit 57 the batten 70 is inserted in the sail. An appropriate material is then glued over the foam layer 56, e.g., a Kevlar strap, a Dacron strap, etc. The advantages of the above combination are also evident when a sail flogs. It has been found that the foam dampens the sail motion, which motion—especially around the battens, tends to introduce failure at the inner end of the batten.

The adhesives employed for the above purposes are those used in sailmaking arts, such as for gluing of seams. These adhesives are freely available on the market.

As it is evident from the above description, considerable savings are effected in the construction of the sail not only from the standpoint of the material, but also the sewing that is associated with it. For example, the corner patches for each of the sails shown in FIGS. 1 to 4 are now made substantially without any sewing and the attachment of these corner patches to the sails is vastly more efficient and less time consuming. The ability of these patches to carry greater loads has been noted. These loads imparted on the sail are met more efficiently than when using previous art techniques of various kinds. Elaborate construction and sewing of gores and strips of material is now eliminated.

Still further, the use of the leech and luff tapes of the type such as of the polyurethane variety again eliminates sewing and provides a tremendous advantage in the speed of the assembly of the sail. Still further, inasmuch as the woven material technology is employed to an insignificant degree, various combinations of threads for each of the particular panels used in a particular location may now be employed with the catenary lines appropriately placed and drawn on the sail such as by a computer. Thus each panel is custom tailored for a particular sail to fit its particular needs in a vastly simpler and faster manner than the approximation by using the woven cloth technology. Although the foam-thread-film assembly has been described for corner reinforcements, an entire sail, such as a mainsail or a jib sail, may also be made incorporating therein the foam material. A sail for a popular boat, a Laser, has been made in this fashion and seems to have outstanding characteristics. Such sails are heavier, but if made two-sided, i.e., foam in the middle and film and threads on the outside, may serve well, e.g., as heavy weather sails.

This technique now as disclosed in this application has been carried even further and applied to spinnakers while heretofore these have not leant themselves readily to construction techniques employing simple panel layouts. Spinnaker production has had to rely on complicated construction techniques which sought to avoid the problems associated with load lines of the woven material. Thus the very complicated and complex tri-radial or off-set tri-radial type of spinnaker can now be replaced by a simple panel layout with no wastage where each of the threads are properly oriented on the spinnaker for the particular location bearing the particular forces at that location.

The use of cross threads 26, e.g., those forming a scrim, has also added the manufacturing benefit in that the panels as these are being laminated with a top film and a bottom film with threads inbetween can be laminated at the same time. The scrim 26 being conjointly fed into the nip of rollers form in one laminating operation an entire panel for the sails.

Although various advantages of the present invention have been described, these all result from the combination of elements shown in the present application and this combination of elements translates itself into a lighter sail capable of bearing the loads better than heretofore due to the construction of the sail all achieved at a sizable cost reduction when compared to the prior art sails employed heretofore. The further advantages over the techniques previously described in my patent '080 reside especially in the assembly and the sail combination improved by the particular addition of the corner patches, as well as the batten pockets and moreover with the luff tapes and leech tapes as described by me. These sails as now assembled with the particular films described herein have achieved a durability heretofore not achieved with any of the plastic film material sails disclosed by the prior art, but more importantly, can now employ films of outstanding durability not possible to achieve when laminating, for example, Mylar, to a woven material.

What is claimed is:

1. In a sail comprised of a number of panels and including point load locations of a head, a tack and a clew, the improvement comprising:

said sail membrane comprised of panels, each constructed of a first polymer film and a second polymer film and between said first and second films a first set of threads aligned in each panel so as to form in said sail substantially a set of catenaries between a tack and a head, a tack and a clew, and a head and a clew, a second set of threads, disposed substantially parallel to seams for said panels, and at least one patch for at least one of said tack, clew and head of the sail, each of said at least one patch comprising a foam layer with a first adhesive coating therefor for adhesively adhering to said first polymer film or second polymer film of said sail membrane, a second adhesive coating on an exterior of said foam, a polymer film for each of said at least one patch for attachment on said exterior of said foam with threads in each of said at least one disposed substantially along load lines conforming to said first set of threads disposed in the sail along said set of catenaries, said polymer film for each of said at least one patch and said threads on each of said at least one patch forming a composite with said foam, wherein at least one of said point load locations for said sail has at least one such patch.

2. A sail as defined in claim 1, wherein said sail has a luff edge, a leech edge and a foot edge, and wherein at least said luff edge of said sail has adheringly attached thereto a polymer film tape.

3. The sail as defined in claim 1, wherein the sail is a mainsail and includes a plurality of point load locations and at least one said batch therefor, said point load locations comprising of a head, a tack, a clew, and at least one reef tack and a reef clew, and wherein each patch for said point load locations is constructed as defined in claim 1.

4. The sail as defined in claim 3, wherein said sail has a plurality of batten pockets each adapted to receive a batten and wherein each of said batten pockets comprise a longitudinal tube of a film material, glued to a panel of said number of panels for said sail, a closure for a leech end of same, a reinforcement for said leech end, an overlay of foam over said longitudinal tube, including a slit for inserting said batten, and an overlayer of a material over said overlay of foam.

5. The sail as defined in claim 1, wherein a panel of said number of panels therefore is of a laminate of said first film with threads thereon, a foam layer, said second film, and a third film with threads thereon.

6. The sail as defined in claim 5, wherein all panels for the sail have a laminate as defined in claim 5.

7. The sail as defined in claim 6, wherein the threads on said first film are proximate to said foam layer of said lamine.

8. The sail as defined in claim 1, wherein the sail is a spinnaker sail and wherein it has a head, a clew and a tack, and wherein each of said head, said clew and said tack has a patch therefor as defined in claim 1, and further wherein a luff, a leech and a foot edge of said sail has adheringly attached thereto a tape film of an aliphatic polyester polyurethane film, said tape film adheringly attached to said sail on both sides thereof.

9. The sail as defined in claim 1, wherein said first and second films for said sail membrane comprise a polyvinylidene fluoride film for each panel of said number of panels, and said at least one patch for each of said point load locations comprises said polymer film with threads disposed thereon conforming to said first set of threads forming said catenaries for said sail.

10. The sail as defined in claim 8, wherein said polymer film for said at least one patch is comprised of polyvinylidene fluoride.

11. The sail as defined in claim 9, wherein said first polymer film is a laminate of polyvinylidene fluoride and another polymer film.

12. The sail as defined in claim 1, wherein the first polymer film and said second polymer film are polymer films having strength properties equal to or better than a polyvinylidene fluoride film of the same thickness.

13. The sail as defined in claim 4, wherein the batten pocket further comprises a loop-and-hook closure for said slit, and wherein said foam over said tube is adhesively secured to said tube.

14. The sail as defined in claim 1, wherein the foam layer for said at least one patch is of a thickness from 1/32 to 3/32 of an inch and is an epoxy foam.

15. The sail as defined in claim 1, wherein said foam for said patch has equivalent or better strength properties than an epoxy foam of the same thickness, and wherein the same has a pressure-sensitive adhesive thereon, which is a resin-modified styrene butadiene rubber.

16. The sail as defined in claim 1, wherein said first and second polymer films are selected from the group consisting of a polyester, an ionomer, a polyvinylidene fluoride, an ethylene chlorotrifluoro ethylene copolymer, an ethylene tetrafluoro ethylene copolymer, a fluorinated ethylene propylene copolymer, a perfluoro alkoxy polymer, a polychloro trifluoro ethylene copolymer, a polyamide, a thermoplastic polyester polyalkyl and a polypropylene.

17. The sail as defined in claim 15, wherein said sail membrane has the first polymer film of polyvinylidene fluoride, and the second film is a laminated film of polyester and polyvinylidene fluoride.

18. The sail as defined in claim 1, wherein the second set of threads are comprised of individual threads.

19. The sail as defined in claim 1, wherein the second set of threads are comprised of a woven scrim.

* * * * *